US009677759B2

(12) United States Patent
Zatti et al.

(10) Patent No.: US 9,677,759 B2
(45) Date of Patent: Jun. 13, 2017

(54) PREMIX GAS BURNER

(71) Applicant: GAS POINT S.R.L., Brescello (IT)

(72) Inventors: Claudio Zatti, Sorbolo (IT); Raffaello Rastelli, Sorbolo (IT); Nicola Lovascio, Sant'ilario d'Enza (IT)

(73) Assignee: Gas Point S.R.L., Brescello (IT)

( * ) Notice: Subject to any disclaimer, the term of this patent is extended or adjusted under 35 U.S.C. 154(b) by 0 days.

(21) Appl. No.: 15/044,057

(22) Filed: Feb. 15, 2016

(65) Prior Publication Data

US 2016/0161112 A1 Jun. 9, 2016

Related U.S. Application Data

(63) Continuation of application No. 13/809,707, filed as application No. PCT/IB2011/001624 on Jul. 12, 2011, now abandoned.

(30) Foreign Application Priority Data

Jul. 12, 2010 (IT) ..... BO2010A0441

(51) Int. Cl.

| | |
|---|---|
| ***F23D 14/04*** | (2006.01) |
| ***F23D 14/60*** | (2006.01) |
| ***F23D 14/34*** | (2006.01) |
| ***F23D 14/62*** | (2006.01) |

(52) U.S. Cl.

CPC ..... *F23D 14/04* (2013.01); *F23D 14/34* (2013.01); *F23D 14/60* (2013.01); *F23D 14/62* (2013.01)

(58) Field of Classification Search

CPC ... F23N 5/18; F23N 5/08; F23D 11/10; F23D 14/06; F23D 14/04; F23D 14/34; F23D 14/60

USPC ..... 431/18, 12; 137/110, 888, 624.18, 613

See application file for complete search history.

(56) References Cited

FOREIGN PATENT DOCUMENTS

| | | | | |
|---|---|---|---|---|
| CA | 2371188 A | * | 12/2000 | ..... F23D 14/60 |
| DE | 4408801 A1 | * | 9/1994 | ..... F23D 14/36 |

* cited by examiner

*Primary Examiner* — Avinash Savani
*Assistant Examiner* — Rabeeul Zuberi
(74) *Attorney, Agent, or Firm* — McCracken & Gillen LLC

(57) ABSTRACT

An air/gas premix burner is disclosed. The air/gas premix burner includes a fan for sending an air/gas mixture towards a combustion head and a gas valve for regulating the introduction of combustible gas. The air/gas premix burner also includes an air/gas mixer, which comprises a localized pressure loss device, and a combustion head. The air/gas mixer includes two channels. One of the channels is provided with two hinged flaps that are designed to open and close for regulating the flow rate of the mixture.

4 Claims, 6 Drawing Sheets

PREMIX GAS BURNER

CROSS REFERENCE TO RELATED APPLICATIONS

The present application is a continuation of U.S. patent application Ser. No. 13/809,707 filed Jan. 11, 2013.

TECHNICAL FIELD

The present invention relates to a total premix gas/air burner (also called "premix burner").

BACKGROUND ART

Total air/gas premix burners are currently known to be widely employed to produce thermal energy in gas boilers.

The use of these burners is becoming rapidly more common, replacing the traditional atmospheric burners because with respect to the latter they allow to:

[A] have lower polluting substance emissions (nitrogen and carbon oxides);

[B] have high thermal exchange efficiencies at all thermal power rates, and in particular at minimum thermal power; and

[C] have high modulation ranges between maximum and minimum thermal power of the burner.

At present premix air/gas burners are mainly made using the following essential components:

a fan for supplying the air/gas mixture to a combustion head;

a "pneumatically" actuated gas valve provided with a flow regulator;

an air/gas mixing system consisting of a venturi channel or diaphragm having a similar function (see below); and a combustion head provided with a device for igniting the air/gas mixture combustion.

In these systems, the "active device" (also called "driver") is represented by the fan which, electrically fed in an appropriate manner, provides comburent air to the burner in amount directly proportional to the thermal power that is intended to be provided to the burner, and thus to the thermal power of the burner head.

The passive device (also called "follower") is represented by the gas valve, which is capable of providing gas in amount directly proportional to the amount of air blown into the system by virtue of the regulation system illustrated thereinafter.

Gas valves are normally characterized in that, independently from the inlet gas pressure (obviously within the working limits allowed by the valve itself and corresponding to the network gas distribution pressures), they provide output gas at a pressure equal to the pressure exerted on their "regulator" except for a difference called "offset" value, adjustable by acting on the valve. In order to expand the modulation range of premix burners of traditional type, the Applicant designed a premix burner of new concept, which was object of international application WO2009/0133451 in the Applicant's name.

Although the results obtained by the premix burner object of international application WO2009/0133451 were overall satisfactory, the reduction of deleterious effects consequent to offset variations which may occur in the gas valve during its long working time was not found optimal.

The present premix burner was designed to solve these drawbacks and must be considered as a further evolution of the premix burner described and claimed in aforesaid international application WO2009/0133451.

The minimum thermal flow rate, i.e. the flow rate in which offset variations of the gas valve correspond to greater air/gas ratio variations, will be taken as reference in order to explain the behavior of the system described in international application WO2009/0133451.

If offset is negative, the gas pressure at the end of the gas feeding pipe is lower than the air pressure at the venturi channel inlet.

Therefore, due to a given air overpressure, there is a passage of air through the nozzle of the venturi channel intersected by the plug, air which enters into the common segment of the gas circuit and dilutes the gas which is entering through the nozzle of the venturi channel free from plug.

Conversely, if offset is positive, the pressure in the common segment of the gas circuit is higher than the air pressure at venturi channel inlet.

Therefore, there is a passage of gas through the venturi channel nozzle intercepted by the plug, gas which enters into the air inlet segment in common to both venturi channels increasing the amount of gas which enters into the venturi channel free from plug.

Finally, if the system works in ideal reference condition, with offset=0 Pa, the air pressures at venturi channel inlet and in the common gas circuit are equal.

Therefore, there is no passage of neither air nor gas through the nozzle of the venturi channel intercepted by the plug and the air/gas ratio will be maintained constant at reference value.

Independently from the offset value set in the gas valve, as the air/gas mixture flow rate aspirated by the fan increases the plug starts opening allowing also its venturi channel to generate vacuum, gradually attenuating the phenomena illustrated above to cancel them out completely and to provide its contribution of the air/gas mixture flow rate with respective ratio values always closer to the reference value which is found at maximum thermal flow rate.

DISCLOSURE OF INVENTION

The present invention is advantageously but not exclusively applied in combination with a combined boiler for the simultaneous or delayed production of heating water and domestic hot water.

It is thus an aim of the present invention to provide a premix burner in which the negative effects are further decreased upon possible offset variations, especially at low delivered thermal power rates.

According to the present invention, a premix burner is thus made in accordance with the appended claims.

BRIEF DESCRIPTION OF THE DRAWINGS

The present invention will now be described with reference to the accompanying drawings, which illustrate four non-limitative embodiments thereof, in which.

BEST MODE FOR CARRYING OUT THE INVENTION

Figure 1:
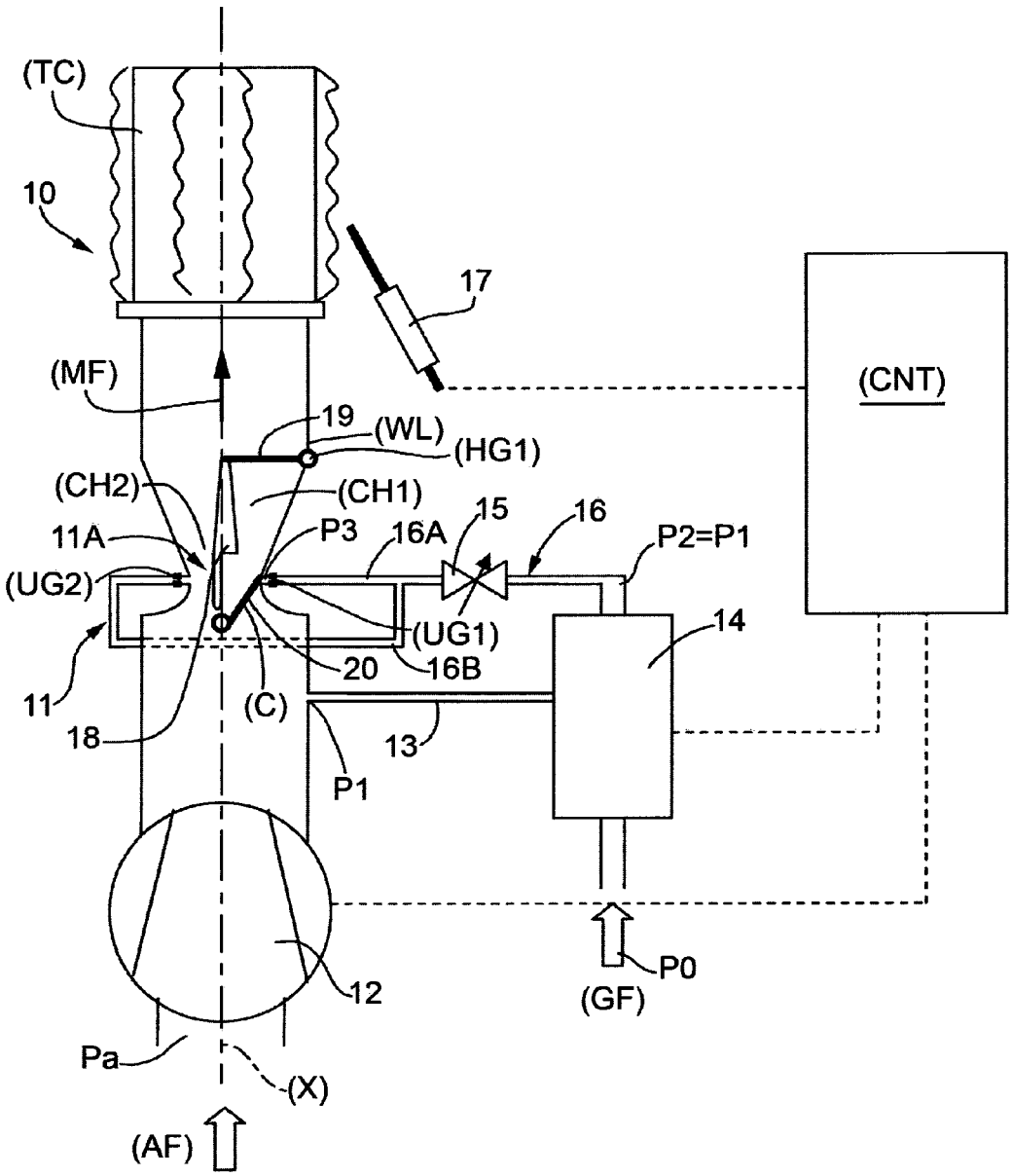
FIG. 1 schematically shows a first embodiment of a premix burner according to the present invention; in this case, the burner is arranged vertically with the fan delivering and in a rest configuration.

In a burner 10 illustrated in FIG. 1 a venturi channel type air/gas mixer 11 is placed downstream of a fan 12 with respect to an air flow (AF). The mixer 11 comprises a localized pressure loss device 11A, in this case constituted by a venturi channel tube.

The burner 10 has a substantially longitudinal symmetry plane (X).

A pipe 13, which carries a pressure signal P1 to a gas valve 14, is connected upstream of the venturi channel type air/gas mixer 11. Furthermore, a gas flow (GF) enters into the gas valve 14 at network pressure Po.

The amount of gas released by the gas valve 14 towards the mixer 11 is correlated to the pressure difference existing between an output pressure P2 of the gas valve 14 (pressure P2 equal to the pressure value P1) and a pressure P3 existing in the narrowest point (the localized loss of pressure device 11A) of the venturi channel type air/gas mixer 11.

The regulation of the air/gas ratio is mainly entrusted to the size of the nozzles (UG1) (UG2), and secondarily to the adjustment of the flow regulator 15.

Each gas inlet point in the localized pressure drop device 11A is equipped, respectively, with a respective nozzle (UG1), (UG2); according to needs, such nozzles (UG1), (UG2) may be equivalent or different to each other. In particular, after the flow regulator 15, a tube 16 forks into two pipes 16A, 16B, each of which feeds a respective nozzle (UG1), (UG2) with gas.

The flow regulator 15 placed on the connection tube 16 between gas valve 14 and venturi channel type air/gas mixer 11 allows to accurately adjust the amount of gas supplied so as to have an optimal air/gas ratio for mixture combustion in a combustion head (TC).

Once gauged by means of the correct dimensioning of the nozzles (UG1) (UG2) and by adjusting the flow regulator 15, the system allows to obtain a constant air/gas ratio throughout the entire working range of the burner 10.

Whatever the air flow value induced by the fan 12, it is indeed apparent that the pressure difference (P1–P3) generated by the air flow and measured between the inlet and the narrowest section of the venturi channel type air/gas mixer 11 will be the same which will generate the gas flow rate exiting from the gas valve 14, being the venturi channel type air/gas mixer 11 a rigid, indeformable mechanical member.

According to a flow (MF), the air/gas mixture is sent towards the combustion head (TC). The burner 10 is completed by an ignition and flame presence detection device 17 and by an electronic control unit (CNT) which controls the working of the fan 12, of the gas valve 14, and of the device 17 itself.

A characterizing element of the embodiment shown in FIG. 1 is constituted in that the venturi channel type air/gas mixer 11 is split into two channels (CH1), (CH2) by a flow divider 18.

The size of the minimum sections of the mixing channels (CH1, CH2) of the fluids are equal to each other so as to generate the same pressure difference, the through air flow being equal.

Alternatively to that described above, the size of the minimum section of the mixing channels (CH1), (CH2) of the fluids may be different so as to provide a different, predetermined pressure difference, the through air flow being equal.

Such flow divider 18 is formed so as to confer to each channel (CH1), respectively, (CH2) the shape of a venturi channel with passage sections which may be circular or non-circular.

Furthermore, the venturi shaped channel (CH1) is closed, according to laws which will be seen in greater detail below by a first plug 19 coupled to a wall (WL) of the burner 10 by means of a respective hinge (HG1).

As will be seen in greater detail below, a second plug 20 hinged to the flow divider 18 by means of a respective hinge (HG2) has been added in order to further decrease the negative effects consequent to the offset variation. The second plug 20 is also positioned at the channel (CH1) and at the nozzle (UG1), so that in the rest condition shown in FIG. 1, the second plug 20 completely surrounds such a nozzle (UG1) and does not allow the gas to flow from the tube 16 to the channel (CH1).

Figure 2:
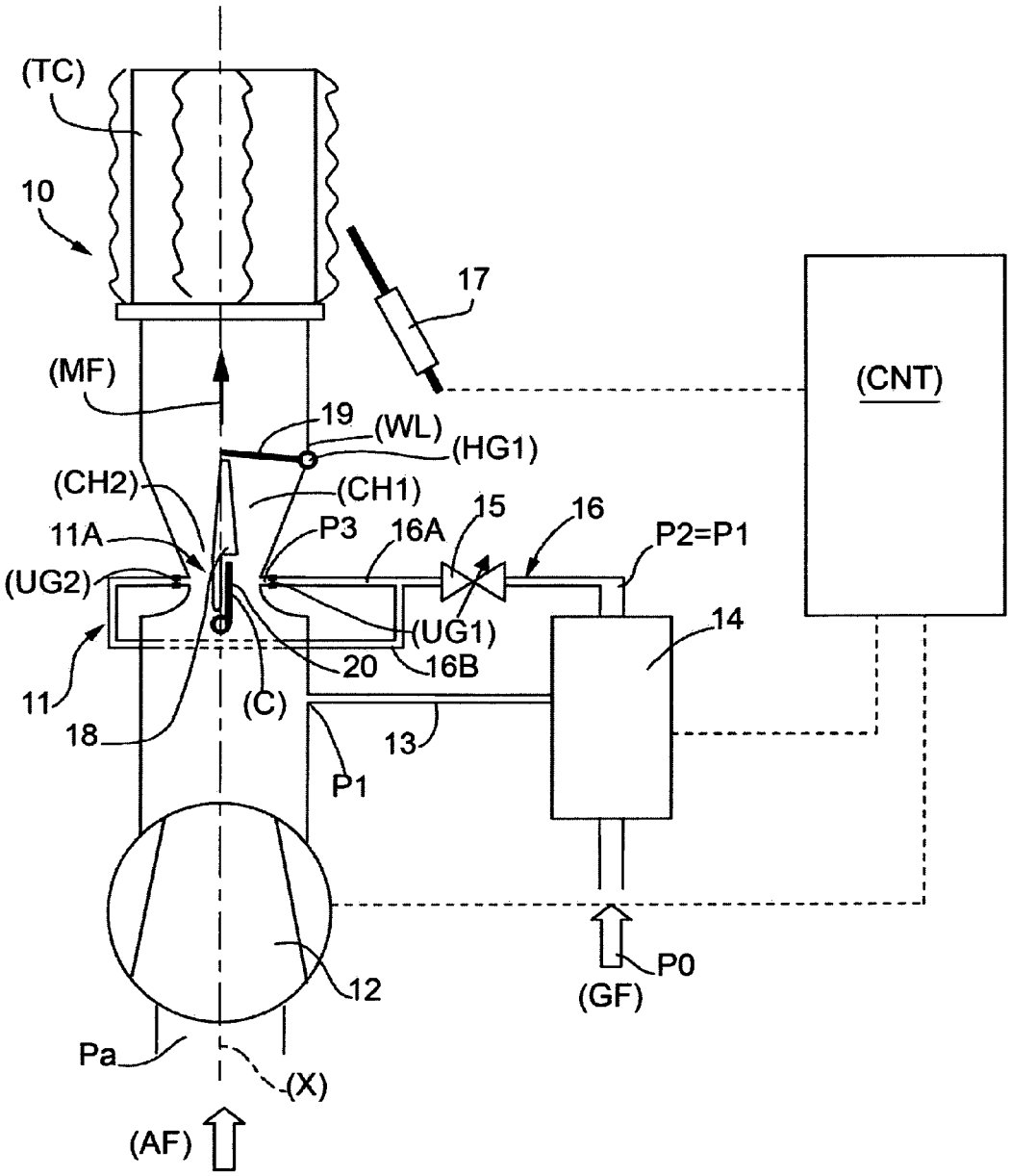
FIG. 2 shows the same burner of FIG. 2, this time, however, in an overflow configuration.
Figure 3:
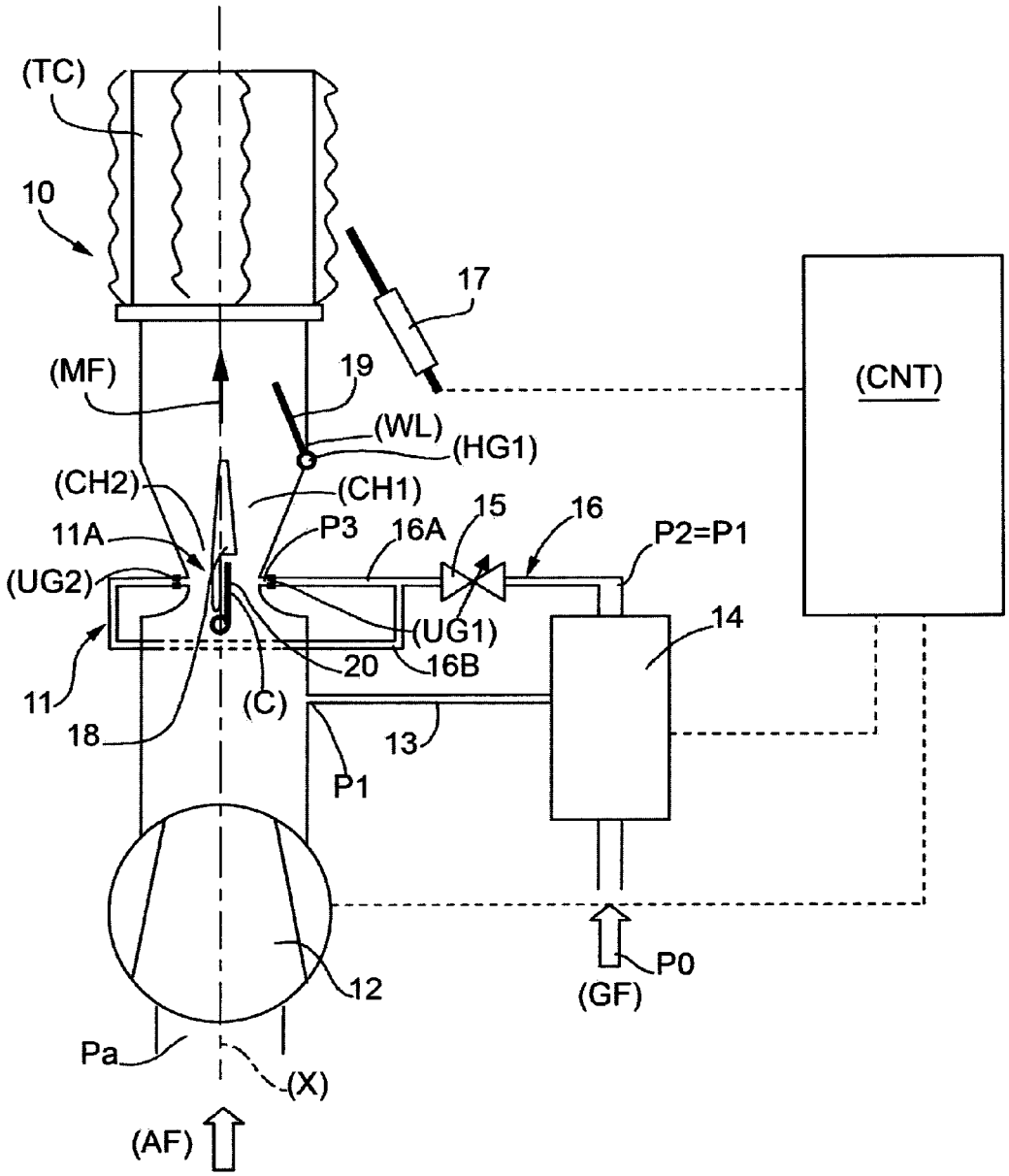
FIG. 3 shows the same burner illustrated in FIGS. 1, 2 in a maximum flow rate configuration.

The second plug 20 has a barycentre (C) which moves upwards by effect of the thrusts of the air/gas mixture transiting towards the channel (CH1) (FIGS. 2, 3).

In these systems, 10% variations of the air/gas ratio and therefore of the CO2 values at the minimum thermal flow rate occur consequent to offset variations of more or less 10% with respect to the vacuum value generated by the venturi channel at the minimum thermal flow rate.

As mentioned above, the minimum thermal flow rate in which offset variations of the gas valve 14 correspond to greater variations of the air/gas ratio will be taken as reference, to explain the behavior of the system.

If the offset is negative, the pressure in the common pipe 16A of the gas circuit is lower than the air pressure at the venturi channel type air/gas mixer 11 inlet.

Therefore, there would be a passage of air through the nozzle (UG1) corresponding to the channel (CH1) in which the first plug 19 is located.

The amount of air which thus enters into the gas pipe 16A dilutes the gas which is entering through the pipe 16B into the channel (CH2) free from the first plug 19.

Conversely, if the offset is positive, the pressure in the common pipe 16A is higher than the air pressure at the venturi channel type air/gas mixer 11 inlet.

Therefore, there is a passage of gas through the nozzle (UG1) of the channel (CH1) intercepted by the first plug 19; gas which enters into the air inlet segment in common to both venturi channels, thus also increasing the amount of gas which enters into the channel (CH2).

Finally, if the system works in ideal reference condition, with offset equal to 0 Pa, the air pressures at venturi channel inlet and in the common gas circuit are equal.

Therefore, there is no passage of neither air nor gas through the nozzle of the venturi channel intercepted by the plug and the air/gas ratio will be maintained constant at reference value.

Independently from the offset value set in the gas valve 14, as the air/gas mixture flow rate delivered by the fan increases the plug 19 starts opening also allowing its venturi channel to generate vacuum, gradually attenuating the phenomena illustrated hereinbefore to cancel them out completely and to provide its contribution to the air/gas mixture flow rate with respective ratio values always closer to the reference value which is found at maximum thermal flow rate.

In brief, the operation of the premix burner 10 is as follows:

both plugs 19, 20 perform their closing action of channel (CH1) by virtue of their own weight;

each plug 19, 20 is hinged in a respective hinge (HG1), (HG2) without contact surfaces by friction except for the hinges (HG1), (HG2) themselves;

in the "minimum thermal flow rate" condition the two plugs 19, 20 are in the closing position shown in FIG. 1;

in this situation, the bi-venturi channel behaves to all effects and purposes as a classic mono-venturi channel, being only the channel (CH2) in operation;

also in presence of negative or positive offsets there is no passage neither of air nor of gas from the nozzle (UG1) closed by the second plug 20;

the weight of the second plug 20 is sufficient in the case of positive offset to overcome the pneumatic thrust of the gas exiting from the nozzle (UG1);

in case of negative offset, the second plug 20 exerts an autoclave closing with regards to the thrust exerted by the air towards the common gas circuit;

at the maximum thermal flow rate shown in FIG. 3 the two plugs 19, 20 are in maximum opening position; indeed, the fluid-dynamic thrust generated by the fan 12 is sufficient to increase both plugs 19, 20 and to maintain them in open position so as to exert a negligible resistance at the passage of the air/gas mixture in the channel (CH1); in this situation, the bi-venturi channel behaves to all effects and purposes as a pair of mono-venturi channels operating in parallel without interposition of any second plug 20; in this case, for the previously illustrated reasons, the presence of negative or positive offsets does not influence the air/gas ratio in any manner; and FIG. 2 shows the transient in which the first plug 19 starts overflowing and letting the air/gas mixture pass into the channel (CH1), while the second plug 20, located on the nozzle (UG1) is in all open position; indeed, shape and weight of the second plug 20 are such that the hydrodynamic thrust exerted by the incoming air is sufficient to fully open such second plug 20 at the beginning of the overflowing of the first plug 19.

It is worth noting that the premix burners, object of international application WO2009/0133451 by the same Applicant, indifferently operate with their axis arranged vertically or horizontally and, for each of these solutions, they may be placed with the fan either aspirating or delivering.

Therefore, the possible solutions included in the present invention, are four as well in order to satisfy the typical current applications with vertical or horizontal axis.

Figure 4:
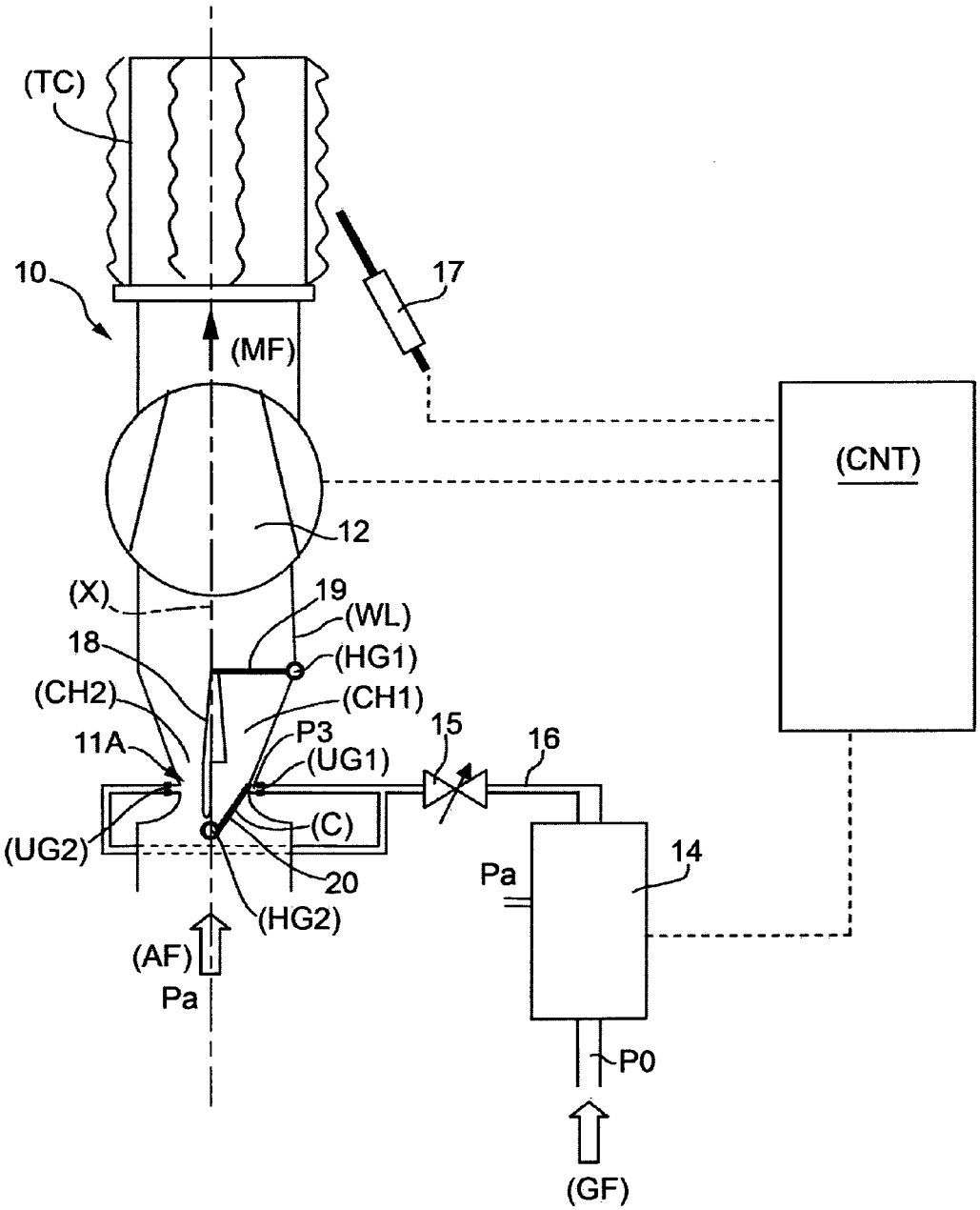
FIG. 4 schematically shows a second embodiment of a premix burner according to the present invention; in this case, the burner is arranged vertically with the fan aspirating and in a rest configuration.
Figure 5:
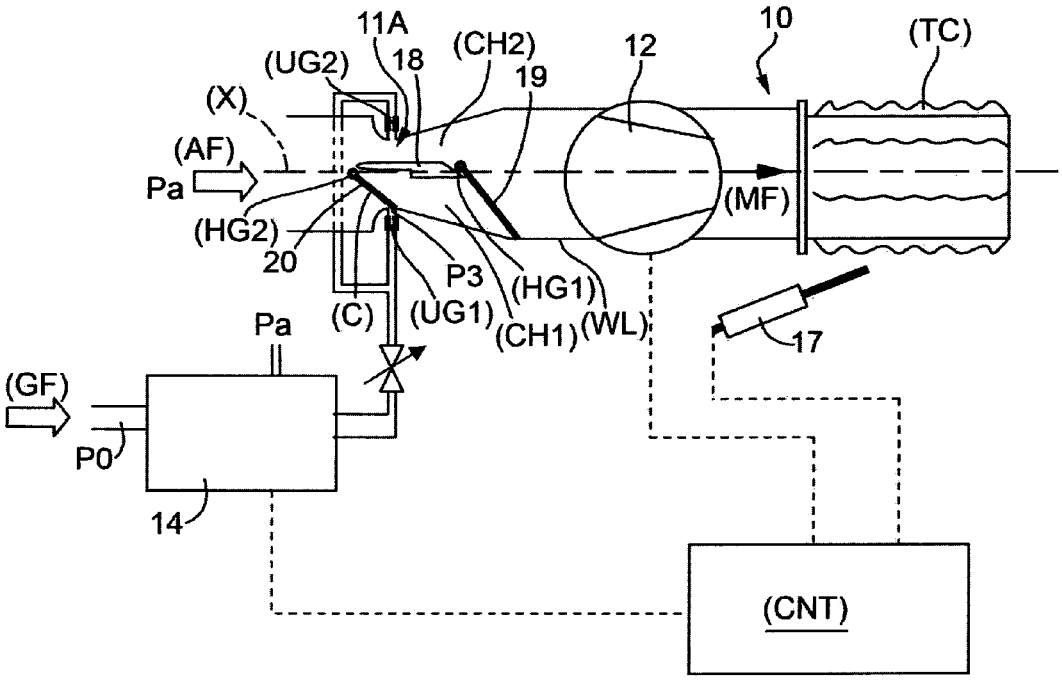
FIG. 5 shows a third embodiment of a burner according to the invention; in this case, the burner is arranged horizontally, the fan is aspirating and in a rest configuration.
Figure 6:
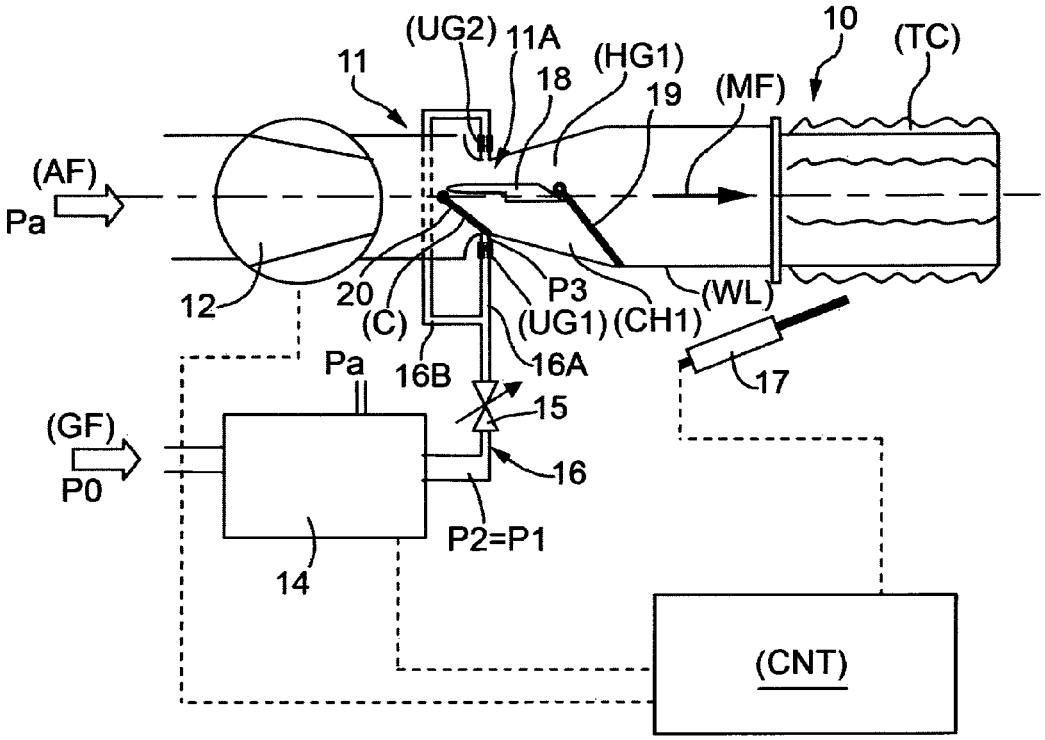
FIG. 6 shows a fourth embodiment of a burner according to the invention; in this case, the burner is arranged horizontally, the fan is delivering and in a rest configuration.

They are illustrated in the present FIGS. 4, 5, 6.

It is apparent that the solutions shown in FIGS. 4 and 5 also apply to a solution in which the burner axis is at −30° with respect to the horizontal.

Furthermore, the solution shown in FIG. 6 is applicable to venturi channel axis in vertical direction.

The advantages of a premix burner according to the present invention essentially consists in that the negative effects consequent to offset variations, also at low power rates of the burner itself, have been considerably decreased.

The invention claimed is:

1. A premix gas burner of an air/gas mixture, comprising the following components:

ventilating means for sending air and the air/gas mixture to a combustion head;

means for regulating an inlet passage of combustible gas;

a system for mixing the air and the combustible gas comprising localized pressure loss means; and the combustion head provided with a device for igniting the air/gas mixture and for detecting the presence of a flame;

wherein said mixing system comprises a plurality of venturi channels for mixing the air with the combustible gas;

wherein at least one gauged mixing channel is provided with first plugging means for adjusting a rate of flow of the air/gas mixture through said at least one gauged mixing channel;

wherein said first plugging means has a first weight and a first shape suitable for opening a passage in the at least one gauged mixing channel to the air, or to the air/gas mixture in a sequence and with pressure difference values higher than a predefined minimum;

wherein the at least one gauged mixing channel provided with said first plugging means is further provided with second plugging means having a second weight and a second shape suitable for opening the inlet passage in said at least one gauged mixing channel in conjunction with the opening of said first passage in the at least one gauged mixing channel by the first plugging means; and wherein each gauged mixing channel provided with the first plugging means is provided with the second plugging means, respectively.

2. A premix gas burner according to claim 1, characterized in that it has a longitudinal plane of symmetry, substantially vertical, or horizontal, or oblique.

3. A premix gas burner according to claim 1, characterized in that when opening, a center of gravity of said second plugging means moves upwards to an open position as a result of thrust from the air/gas mixture, and when closing, the center of gravity of said second plugging means automatically moves downward to a closed position again as a result of the weight of the second plugging means.

4. A premix gas burner according to claim 3, characterized in that said second plugging means are coupled to a respective hinge arranged on a flow divider element.

* * * * *